US009954305B2

(12) United States Patent
Yu et al.

(10) Patent No.: US 9,954,305 B2
(45) Date of Patent: Apr. 24, 2018

(54) ELECTRIC CONNECTOR

(71) Applicant: Tyco Electronics (Shanghai) Co. Ltd., Shanghai (CN)

(72) Inventors: Jianfei Yu, Shanghai (CN); Qijun Zhao, Shanghai (CN); Hao Wang, Shanghai (CN); Zhigang Cheng, Shanghai (CN); Bo Gao, Shanghai (CN); Yuquan Chen, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 14/824,854

(22) Filed: Aug. 12, 2015

(65) Prior Publication Data

US 2016/0049747 A1 Feb. 18, 2016

(30) Foreign Application Priority Data

Aug. 12, 2014 (CN) ..... 2014 2 0452122 U

(51) Int. Cl.

| | |
|---|---|
| ***H01R 13/52*** | (2006.01) |
| ***H01R 13/424*** | (2006.01) |
| ***H01R 13/514*** | (2006.01) |
| ***H01R 13/502*** | (2006.01) |
| *H01R 13/506* | (2006.01) |

(52) U.S. Cl.

CPC ..... *H01R 13/5219* (2013.01); *H01R 13/424* (2013.01); *H01R 13/502* (2013.01); *H01R 13/514* (2013.01); *H01R 13/506* (2013.01)

(58) Field of Classification Search

CPC ..... H01R 13/5219; H01R 13/502; H01R 13/424; H01R 13/514; H01R 13/506

USPC ..... 439/271, 638, 687, 696, 731, 934, 460

See application file for complete search history.

(56) References Cited

U.S. PATENT DOCUMENTS

| | | | | | |
|---|---|---|---|---|---|
| 2,639,312 | A * | 5/1953 | Kerwin | H02G 1/145 | 174/138 F |
| 5,076,806 | A * | 12/1991 | Hotea | H01R 13/42 | 439/278 |
| 5,122,077 | A * | 6/1992 | Maejima | H01R 13/514 | 439/398 |
| 5,588,870 | A * | 12/1996 | Boteler | H01R 13/502 | 439/467 |
| 6,176,745 | B1 * | 1/2001 | Furutani | H01R 13/506 | 439/701 |

(Continued)

*Primary Examiner* — Michael A Lyons
*Assistant Examiner* — Milagros Jeancharles
(74) *Attorney, Agent, or Firm* — Barley Snyder

(57) ABSTRACT

An electric connector, comprising: a housing, an insulation body received in the housing, and a plurality of terminals held in a plurality of slots of the insulation body. The insulation body comprises a first half body and a second half body separate from the first half body The first half body and the second half body are configured to be detachably assembled together. Therefore, when connecting cables in field, the insulation body may be separated into the first half body and the second half body first. Then the cables may be connected to the terminals held in the first half body and the second half body. The first half body and the second half body may be assembled together after the cables are connected. Using such a detachable insulation body provides larger operation space, thus easing connecting the cables to the terminals in the field.

6 Claims, 5 Drawing Sheets

(56) References Cited

U.S. PATENT DOCUMENTS 6,217,385 B1 * 4/2001 Genta ..... H01R 13/5208 439/587
6,231,398 B1 * 5/2001 Furutani ..... H01R 13/506 439/701
6,596,806 B2 * 7/2003 Asano ..... C08J 3/205 524/463
6,764,350 B2 * 7/2004 Kosmala ..... H01R 9/032 439/598
6,855,888 B2 * 2/2005 Jacke ..... H01R 13/59 174/84 R
7,044,789 B2 * 5/2006 Yohn ..... H01R 13/6592 439/599
7,344,408 B2 * 3/2008 Kato ..... H01R 13/5205 439/578
7,351,117 B1 * 4/2008 Mostoller ..... H01R 13/428 439/744
7,736,159 B1 * 6/2010 Effinger, III ..... H01R 24/86 439/108
7,789,718 B2 * 9/2010 Desard ..... H01R 4/36 439/276
8,465,300 B2 * 6/2013 Lin ..... H01R 24/86 439/101
8,586,868 B2 * 11/2013 Liu ..... H02G 3/0481 174/113 C
8,591,268 B2 * 11/2013 Reimchen ..... H01R 9/03 439/689
8,801,442 B2 * 8/2014 Quero ..... H01R 9/03 174/541
8,915,758 B2 * 12/2014 Shishikura ..... H01R 13/506 439/701
9,118,138 B2 * 8/2015 Bianca ..... H01R 13/424
2006/0035514 A1 * 2/2006 Yohn ..... H01R 9/03 439/460
2006/0051999 A1 * 3/2006 Allemann ..... H01R 13/622 439/320
2009/0269958 A1 * 10/2009 Fujiwara ..... H01R 13/5219 439/320
2010/0015844 A1 * 1/2010 De Dios Martin .. H01R 4/2433 439/395
2011/0136369 A1 * 6/2011 Dang ..... H01R 4/18 439/352
2011/0294342 A1 * 12/2011 DeBock ..... H01R 13/514 439/527
2012/0034809 A1 * 2/2012 Reimchen ..... H01R 9/03 439/362
2013/0130535 A1 * 5/2013 Plazio ..... H01R 13/506 439/350
2013/0137310 A1 * 5/2013 Genau ..... H01R 12/724 439/660
2014/0242840 A1 * 8/2014 Dang ..... H01R 13/6461 439/607.01
2016/0359258 A1 * 12/2016 Koester ..... H01R 13/436

* cited by examiner

ELECTRIC CONNECTOR

CROSS-REFERENCE TO RELATED APPLICATION

This application claims the benefit of Chinese Patent Application No. 201420452122.X filed on Aug. 12, 2014 in the State Intellectual Property Office of China, the whole disclosure of which is incorporated herein by reference.

FIELD OF THE INVENTION

Embodiments of the present disclosure relate to an electric connector, especially to a cylindrical electric connector.

BACKGROUND

It is well known that a cylindrical electric connector generally includes a housing, an insulation body received in the housing, and a plurality of terminals held in the insulation body. Conventionally, the insulation body for holding and fixing the plurality of terminals is integrally formed. Due to small operation space when connecting a plurality of cables to the plurality of terminals in field, operation of the cylindrical electric connector is inconvenient. Furthermore, the connection portion of such an integral insulation body tends to break up after being folded repeatedly, which reduces its service life.

SUMMARY

The purpose of the present disclosure is intended to solve at least one aspect of the above issues and faults in the prior art.

One object of the present disclosure is to provide an electric connector which facilitates the connection of cables to terminals in the field.

Another object of the present disclosure is to provide an electric connector with long service life.

Another object of the present disclosure is to provide an electric connector which is very simple in structure and easy to manufacture.

Accordingly, an electric connector, constructed in accordance with the present invention, includes a housing, an insulation body received in the housing, and a plurality of terminals. The insulation body has a first half body having a plurality of slots and a second half having a plurality of slots body. The first half body of the insulation body and the second half body of the insulation body are detachably joined. The plurality of the terminals is fitted in the plurality of slots of the insulation body.

In the electric connectors according to various embodiments of the present invention, the insulation body consists of a first half body and a second half body. When connecting cables in the field, the insulation body may be separated into the first half body and the second half body first, then the cables may be connected to the terminals held in the first half body and the second half body. The first half body and the second half body are assembled together after the cables being connected. Using such a detachable insulation body provides larger operation space. Thus, the cables may be easily connected to the terminals in the field. Furthermore, the first half body and the second half body are assembled together in a snap-fit manner, whereby the insulation body may be reused over a long time and have a long service life.

Additionally, such a detachable insulation body is easily produced and assembled and may ensure position accuracy of the terminals.

Other characteristics and advantages of the present disclosure will be made clear by the following detailed description, the comprehension of which will be facilitated by reference to the attached drawings.

BRIEF DESCRIPTION OF THE DRAWINGS

The present invention will be further described in detail with reference to the accompanying drawings, in which.

DETAILED DESCRIPTION OF THE EMBODIMENT(S)

Figure 1:
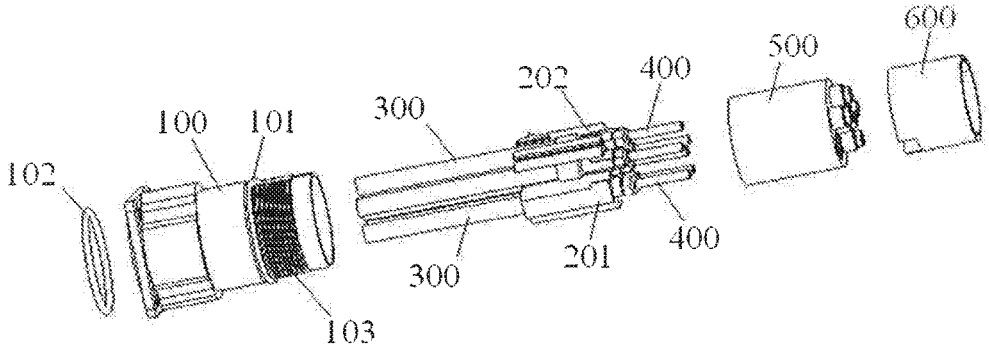
FIG. 1 is a schematic exploded view showing an electric connector according to an exemplary embodiment of the present invention.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2:
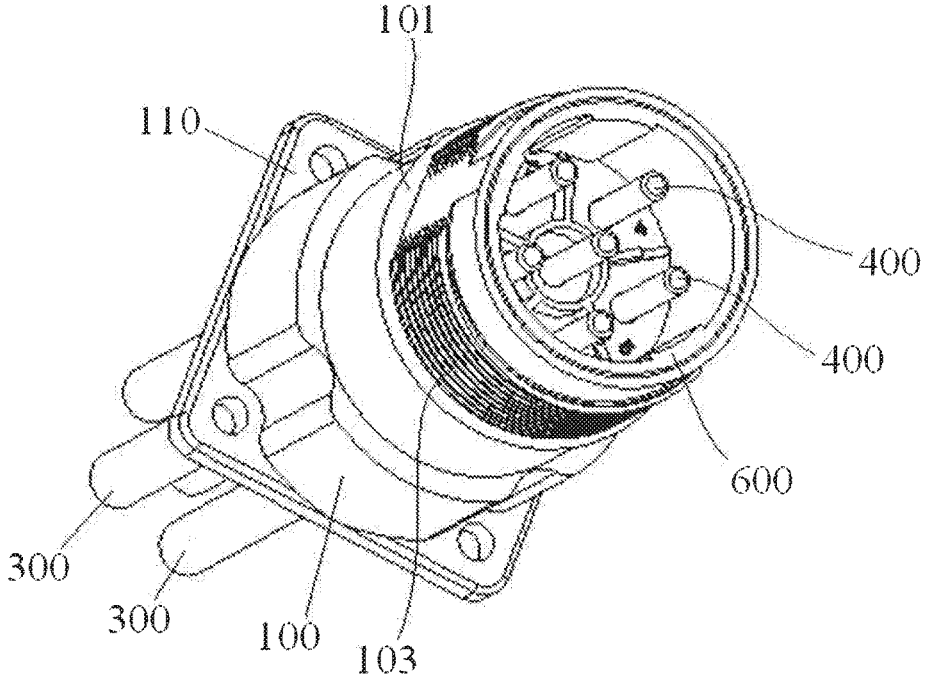
FIG. 2 is a schematic assembled view showing the electric connector according to the exemplary embodiment of the present invention.
Figure 3:
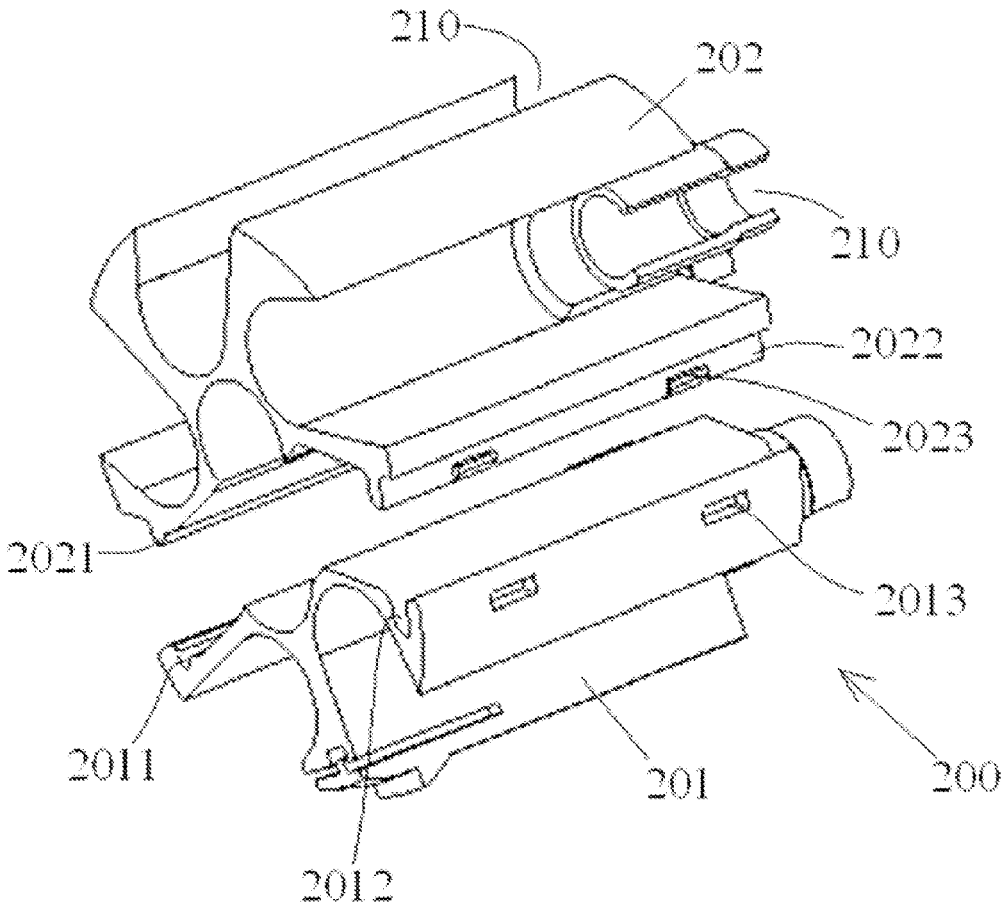
FIG. 3 is a schematic exploded view showing the insulation body of the electric connector of FIGS. 1 and 2 as being composed of a first half body and a second half body.

As shown in FIGS. 1, 2, and 3, in an exemplary embodiment of the present invention, the electric connector primarily comprises a housing 100, an insulation body 200, and a plurality of terminals 400.

The insulation body 200 is received in the housing 100. The plurality of terminals 400 are held in a plurality of slots 210 of the insulation body 200.

Figure 4:
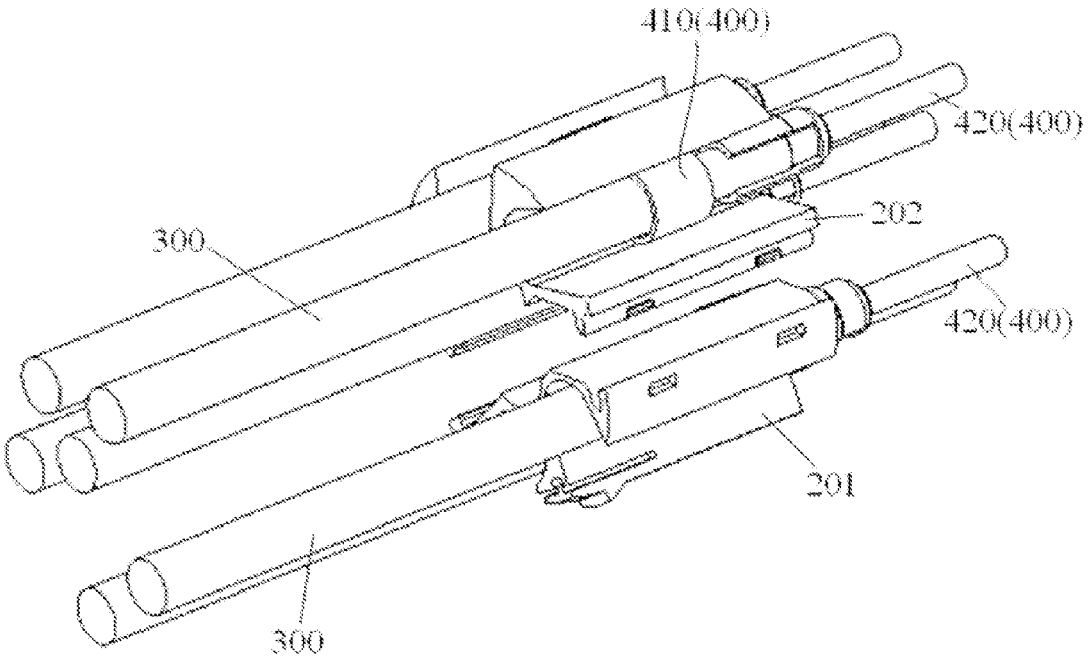
FIG. 4 is a schematic view showing cables connected to terminals in the first half body and the second half body of the insulation body.
Figure 5:
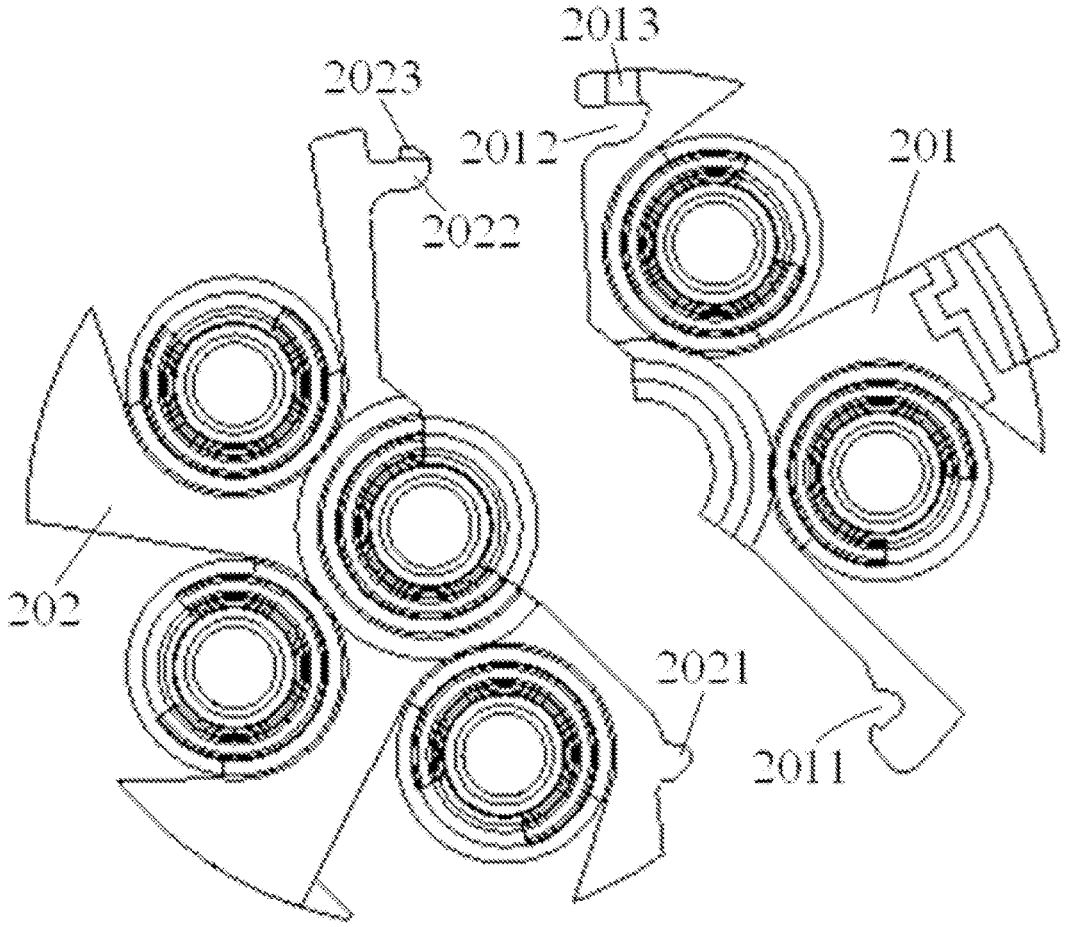
FIG. 5 is a transverse cross section view showing the first half body and the second half body of the insulation body shown in FIG. 4.
Figure 6:
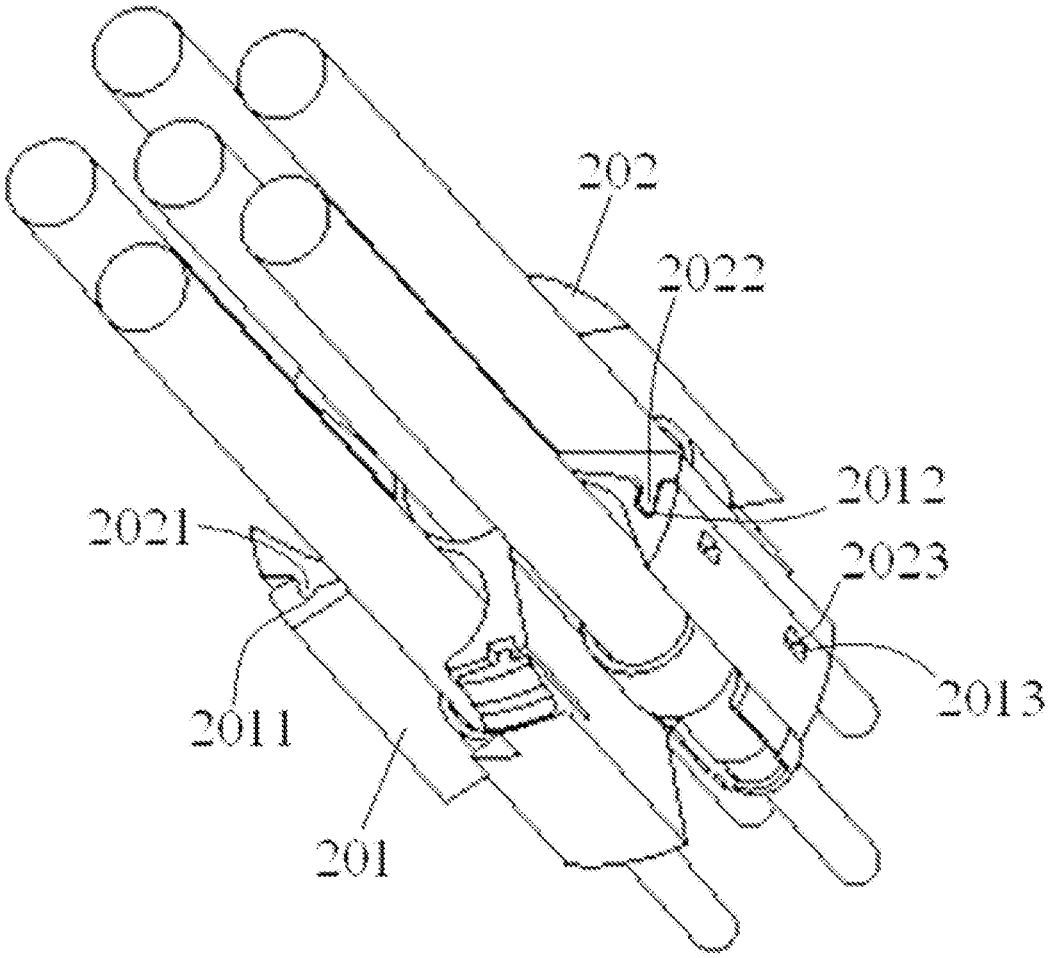
FIG. 6 is a schematic view showing a whole insulation body formed by assembling the first half body and the second half body shown in FIG. 4.

FIG. 3 shows the insulation body 200 of the electric connector of FIG. 1 as being in two body parts. A first half body is identified by reference numeral 201 and a second half body is identified by reference numeral 202. FIG. 4 shows a plurality of cables 300 connected to terminals 400 in the first half body 201 and the second half body 202, respectively. FIG. 5 shows the first half body 201 and the second half body 202 of the insulation body 200 shown in FIG. 4. FIG. 6 shows the whole insulation body 200 formed by assembling the first half body 201 and the second half body 202 shown in FIG. 4.

As shown in FIGS. 3-6, in an exemplary embodiment of the present invention, the insulation body 200 comprises a first half body 201 and a second half body 202 separate from the first half body 201, with the first half body 201 and the second half body 202 configured to be detachably assembled together.

Still referring to FIGS. 3-6, in the illustrated embodiment, a first recess 2011 is provided on one side of the first half body 201 and a second recess 2012 is provided on the other side of the first half body. A first convex portion 2021 is provided on one side of the second half body 202 and a second convex portion 2022 is provided on the other side of second half body. The first convex portion 2021 is configured to be engaged in the first recess 2011 and the second convex portion 2022 is configured to be engaged in the second recess 2012. Thus, the first half body 201 and the second half body 202 are assembled together to form a whole insulation body 200.

Still referring to FIGS. 3-6, in an exemplary embodiment of the present invention, at least one indentation 2013 is provided on a sidewall of the first recess 2011 and the second recess 2012. At least one protrusion 2023 is provided on an outer wall of the first convex portion 2021 and the second convex portion 2022. When the convex portions engage the associated recesses, the protrusion 2023 snaps into the associated indentation 2013. Thus, the first half body 201 and the second half body 202 are locked together to prevent the first half body 201 and the second half body 202 from being detached from each other.

As shown clearly in FIGS. 3 and 4, each of the plurality of slots 210 has a C-shaped cross section and extends in a longitudinal direction of the insulation body 200. The plurality of terminals 400 are pressed into the plurality of slots 210 through openings of the slots 210 in a radial direction of the insulation body 200.

As shown in FIG. 4, in an exemplary embodiment of the present invention, each of the terminals 400 comprises a tubular base 410 and an elongated pin 420 extending from the tubular base 410. One end of a cable 300 is inserted into and electrically connected to the tubular base 410. The elongated pin 420 is adapted for insertion into a jack of a mating electrical connector (not shown) so as to be electrically connected to a terminal of the mating electrical connector.

As shown in FIGS. 1 and 2, in an exemplary embodiment of the present invention, the electric connector further comprises a sleeve 500. The sleeve 500 is placed over the insulation body 200 and covers the insulation body to prevent the terminals 400 from moving radially and detaching from the slots 210 of the insulation body.

As shown in FIGS. 1 and 2, in an exemplary embodiment of the present invention, the electric connector further comprises an end cover 600. The end cover 600 is placed over one end of the sleeve 500 facing outwards and the pins 420 of the terminals 400 pass through the end cover 600.

As shown in FIGS. 1 and 2, in an exemplary embodiment of the present invention, a positioning feature is provided on the end cover 600 that is positioned to cooperate with a positioning feature provided on an end cover of the mating electric connector to correctly couple together the electric connector with the mating electric connector.

As shown in FIGS. 1 and 2, in an exemplary embodiment of the present invention, the housing 100 of the electric connector has thread 103 for engagement with a mating thread of a housing of the mating electric connector.

As shown in FIGS. 1 and 2, in an exemplary embodiment of the present invention, a first seal ring 101 is provided on the housing 100 of the electric connector. When the housing 100 of the electric connector is connected to the housing of the mating electric connector, the first seal ring 101 is pressed between the housing 100 of the electric connector and the housing of the mating electric connector to seal the interface between the housing 100 of the electric connector and the housing of the mating electric connector.

As shown in FIGS. 1 and 2, in an exemplary embodiment of the present invention, the housing 100 of the electric connector has a base plate 110 and a second seal ring 102 is provided on a bottom surface of the base plate 110. When the base plate 110 is mounted onto a mounting plate (not shown), the second seal ring 102 is pressed between the base plate 110 and the mounting plate to seal the interface between the base plate 110 and the mounting plate.

As shown in FIGS. 1 and 2, in an exemplary embodiment of the present invention, the electric connector has a substantially cylindrical shape. Therefore, the electric connector illustrated may be referred to as a cylindrical electric connector.

It should be appreciated by those skilled in this art that the above embodiments are intended to be illustrative and not restrictive. For example, many modifications may be made to the above embodiments by those skilled in this art and various features described in different embodiments may be freely combined with each other without conflicting in configuration or principle.

Although several exemplary embodiments have been shown and described, it will be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plurals of these elements, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. An electric connector, comprising:

a housing;

an insulation body received in the housing and having:

(a) a first half body having a plurality of slots, a first recess on a first side having an indentation in a wall thereof, and a second recess on a second side having an indentation in a wall thereof, and (b) a second half body detachably joined to the first half body and having a plurality of slots, a first convex portion on a first side having a protrusion on a wall thereof engaged in the indentation in the first recess of the first half body, and a second convex portion on a second side having a protrusion on a wall thereof engaged in the indentation in the second recess of the first half body, one of the slots formed between the first half body and the second half body and enclosed when the second half body is joined to the first half body, each of the plurality of slots of the insulation body having a C-shaped cross section that extends in a longitudinal direction of the insulation body;

a plurality of terminals press-fit in the plurality of slots of the insulation body, each terminal having:

(a) a tubular base for receiving and electrically connecting one end of a cable, and (b) an elongated pin adapted to be inserted into a jack of a mating electrical connector so as to be electrically connected to a terminal of the mating electrical connector;

a sleeve covering the insulation body and preventing the terminals from moving radially away from the plurality of slots; and an end cover positioned over an end of the sleeve with the pins of the terminals passing through the end cover, the end cover having a positioning feature adapted to cooperate with a positioning feature on a mating electric connector to correctly couple together the electric connector with the mating electric connector.

2. The electric connector according to claim 1, wherein the housing has a thread adapted for threading the housing to the mating electric connector.

3. The electric connector according to claim 2, further including a seal ring on the housing which is pressed between the housing and a mating electric connector and seals the interface between the housing and the mating electric connector.

4. The electric connector according to claim 3, wherein the housing has a base plate and the electric connector further includes a second seal ring that is pressed between the base plate and a mounting plate to seal the interface between the base plate and the mounting plate.

5. The electric connector according to claim 4, wherein the electric connector has a substantially cylindrical shape.

6. The electric connector according to claim 1, wherein another one of the slots is formed along an exterior of the first half body or the second half body when the second half body is joined to the first half body.

* * * * *